United States Patent [19]

Birleson

[11] Patent Number: 5,013,979

[45] Date of Patent: May 7, 1991

[54] PHASED FREQUENCY STEERED ANTENNA ARRAY

[75] Inventor: Stanley V. Birleson, Rowlett, Tex.

[73] Assignee: Texas Instrument Incorporated, Dallas, Tex.

[21] Appl. No.: 459,002

[22] Filed: Dec. 29, 1989

[51] Int. Cl.[5] ..... H01Q 3/22

[52] U.S. Cl. ..... 342/375; 342/372

[58] Field of Search ..... 342/375, 372

[56] References Cited

U.S. PATENT DOCUMENTS 4,814,779 3/1989 Levine ..... 342/375

*Primary Examiner*—Theodore M. Blum

*Attorney, Agent, or Firm*—René E. Grossman; Melvin Sharp

[57] ABSTRACT

A broadband phased frequency antenna array uses frequency steering with phase-shift stabilization. Phased frequency steering allows wider intermediate bandwidth than available from frequency steered arrays, with fewer phase shifters than required by phase steered arrays. For a given instantaneous bandwidth (such as for FM-chirp or frequency agility operations), the phased frequency steered array provides a straightforward trade-off between sidelobe level and the number of phase shifters. The antenna includes a linear array (10) of phase-shift/time-delay modules (FIG. 1*b*), each including (a) a phase-shift element (PSE) with a phase shifter (PS), and (b) a number of time-delay elements (TDE) coupled through respective time-delay feeds (TDF) to the phase shifter. In accordance with conventional antenna pattern weighting, the phase shifters are concentrated in the center of the array (10), with the number of time-delay elements in a phase-shift/time-delay module increasing for modules located toward the edge of the array, producing the desired phase shifter "thinning". The phase shifter of each phase-shift-/time-delay module is cooperatively set relative to a scan frequency to provide an appropriate phase-shift offset that aligns the phase front segments ($S_0$–$S_{13}$), achieving a continuous phase slope across the phase front (FIG. 1*c*).

25 Claims, 3 Drawing Sheets

10
21
22
23
24
25
30
31
32
34
36
38
Σ
Δ
θ
PSE
TDE
TDF
PS
φ

PHASED FREQUENCY STEERED ANTENNA ARRAY

TECHNICAL FIELD OF THE INVENTION

This invention relates in general to electronically steered antenna arrays, and more particularly to a phased frequency steered antenna array and method that uses frequency steering with phase-shift stabilization.

BACKGROUND OF THE INVENTION

Two common techniques for electronically steering a radio frequency antenna array are phase steering and frequency steering. Generally, phase steered arrays permit relatively large changes in instantaneous frequency without significantly affecting angular accuracy, but typically incorporate a phase shifter or active phase-shift module for each radiating element. In contrast, frequency steered antennas avoid the cost of the phase-shift components, but provide less instantaneous bandwidth at a given scan angle because changes in instantaneous frequency also affect angular accuracy.

For example, some radar applications require greater instantaneous bandwidth, such as to support frequency agile operation and/or FM-chirp pulse compression, than is available from an albeit less complex frequency steered antenna (given the typical sidelobe level requirements). For these applications, a phase steered antenna is the only practical solution to achieve the desired instantaneous bandwidth while maintaining angular accuracy.

The requirement of a phase shifter or active module for each radiating element is a significant cost factor for these antenna systems. By way of illustration, for a phase steered antenna that provides a two-dimensional scan in the X band (around 10 GHz with a wavelength of about 3 centimeters), the typical radiating-element spacing of one-half wavelength requires a radiating element about every 1.5 centimeters.

The conventional approach to reducing the cost of a phase steered antenna array is to thin the array, either by (a) removing phase shifters (sparsely sampling), or (b) by using frequency scan in one dimension. Sparsely sampling only allows removing 5 to 15 percent of the phase-shifters before sidelobe levels are raised significantly. In contrast, using frequency scan in one dimension reduces the number of phase-shifters to one per row or column, or two for monopulse systems (one for each half of the row or column) without significantly impacting sidelobe levels. However, angular accuracy in that dimension degrades due to incremental beam scanning caused by instantaneous changes in frequency, limiting the broadband capability of the antenna.

Accordingly, a need exists for an improved broadband electronically steered antenna array capable of instantaneous bandwidth performance comparable to phase steered antennas, but with significantly fewer phase-shifter components, and without (a) significantly raising sidelobe levels (such as would be caused by sparsely sampling), or (b) significantly degrading angular accuracy (such as would be caused by frequency scanning in one dimension).

SUMMARY OF THE INVENTION

The present invention is an improved electronically steered antenna array using frequency scanning with phase-shift stabilization to provide broadband performance using relatively few phase-shift elements compared to phase steered arrays, but without significantly sacrificing angular accuracy compared to broadband frequency steered arrays.

In one aspect of the invention, a phased frequency steered antenna array includes multiple phase-shift-/time-delay modules. Each phase-shift/time-delay module includes (a) a phase-shift component for introducing a selected phase-shift, (b) an associated phase-shift aperture element, and (c) at least one time-delay aperture element for introducing a selected time-delay phase-shift. The phase-shift component is RF-coupled both to the phase shift element, and the time delay element.

In terms of the transmit mode (the receive mode is reciprocal), electromagnetic energy is fed to each phase-shift/time-delay module, where the phase-shift component introduces the selected phase shift. The phase-shifted electromagnetic energy is radiated by the associated phase-shift aperture element, and by the time delay element which introduces the selected time-delay phase-shift.

Preferably, for a given scan-angle frequency, the phase shifts introduced by the phase shift components for the phase-shift/time-delay modules are cooperatively selected to provide a corresponding phase-shift offset for the phase front segment attributable to each module, thereby aligning the phase front segments to obtain a substantially continuous phase slope across the phase front. Two-dimensional scanning can be provided by stacking linear arrays of phase-shift/time-delay modules, and using phase steering in the stack dimension for scanning.

In more specific aspects of the invention, the phased frequency steered antenna includes a linear array of phase-shift/time-delay modules, providing a linear array of selectively-spaced aperture elements with a selected distribution of phase shift and time delay elements. For a given scan-angle frequency, the phase-shift offsets provided by the phase-shift components in the phase-shift/time-delay modules are cooperatively chosen to align the corresponding phase front segments at the center-frequency (scan-angle frequency) of the instantaneous bandwidth.

The phased frequency steering technique using multiple phase-shift/time-delay modules is independent of the type of phase shift element or time delay element, either of which may be active or passive. For a given instantaneous bandwidth specification, antenna configuration involves a cost/performance trade-off between the phase-shift/time-delay element ratio (thinning) and sidelobe level. In general, reducing the number of phase shift elements, and thereby increasing the number of time delay elements, raises sidelobe levels for a given instantaneous bandwidth, although in all cases, instantaneous bandwidth and sidelobe level performance is significantly enhanced over that achievable by a correspondingly thinned phase steered array.

Thus, the phased frequency steering technique of the invention involves inserting into a frequency steered array of time delay elements, a selected number of phase shift elements. The phase shift elements provide phase-shift offsets to maintain phase slope alignment, stabilizing the frequency scan to reduce the effect of instantaneous frequency changes on angular accuracy.

The technical advantages of the invention include the following. The phased frequency steered antenna array provides a cost effective alternative to phase steered antennas for applications in which instantaneous bandwidth requirements (such as for frequency agility and/or FM chirp) make frequency steered arrays impractical. Phased frequency steering uses phase shift elements to provide angular stabilization for frequency scanning, achieving a higher effective thinning ratio than a phase steered array with comparable sidelobe levels and instantaneous bandwidth. Phased frequency steering provides a relatively straightforward cost/performance trade-off between the number of phase shift elements required and the sidelobe level, for a given instantaneous bandwidth. The antenna sidelobes in the plane of thinning are moderately increased for wide instantaneous bandwidths, but sidelobe levels are not degraded in the orthogonal plane, and main beam monopulse performance is not significantly degraded. Moreover, the technique has no significant effect on radar cross section. The phased frequency steering technique has general applicability to surface, airborne, and space-based electronically steered antenna arrays, either active or passive. With the phase-shift stabilization provided by this technique, the monopulse null and the main beam do not significantly scan as a result of instantaneous frequency changes, allowing a corresponding increase in instantaneous bandwidth over that available from conventional frequency steered antenna arrays.

BRIEF DESCRIPTION OF THE DRAWINGS

For a more complete understanding of the present invention, and for further features and advantages, reference is now made to the following Detailed Description, taken in conjunction with the accompanying Drawings, in which.

DETAILED DESCRIPTION OF THE INVENTION

Figures 1A, 1B, 1C:
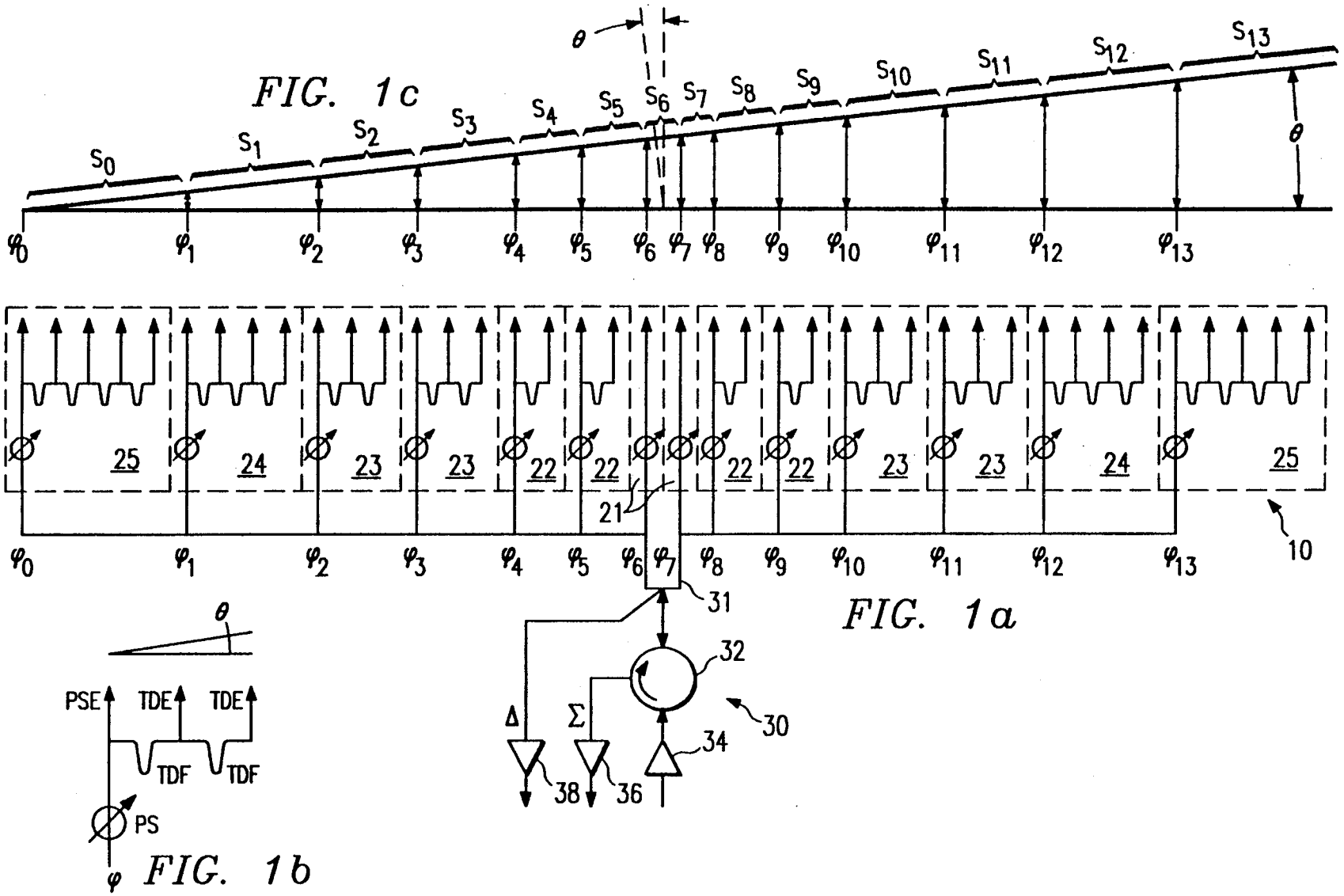
FIG. 1*a* illustrates an exemplary configuration for a phased frequency steered antenna array according to the invention, showing multiple phase-shift/time-delay modules arranged in a linear array.
FIG. 1*b* is a detailed illustration of a three-element phase-shift/time-delay module.
FIG. 1*c* is a plot of the phase front across the linear array of phase-sift/time-delay modules, illustrating the use of the phase shift elements to introduce corresponding phase-shift offsets to align the phase front segments and obtain a continuous phase front.

The Detailed Description of an exemplary embodiment of the phased frequency steered antenna array and method of the invention is organized as follows:

1. Frequency Scan with Phase-Shift stabilization
2. Phased Frequency Steered Array
   2.1. Phase Slope Alignment
   2.2. Array Configuration
3. Two-Dimensional Array
4. Exemplary Microwave Module
5. Conclusion The exemplary embodiment of the phased frequency steering technique is described in relation to an exemplary radar application in which, within a total bandwidth available for frequency scanning, an instantaneous bandwidth is available at each scan angle (and associated scan frequency) to support, for example, frequency agile operations and/or FM-chirp pulse compression). In addition, an exemplary microwave module configuration using a serpentine waveguide to feed the time-delay aperture elements is described.

While the Detailed Description is in relation to this exemplary application, the present invention has general application to providing phased frequency steering using frequency scanning with phase-shift stabilization of the scan angle during instantaneous frequency changes. Specifically, the invention has general application to electronically steered broadband antenna arrays.

For the sake of brevity, the Detailed Description focuses on the use of the exemplary phased frequency antenna in the transmit mode. The operation of the phased frequency antenna in the receive mode (including for passive direction finding systems) is reciprocal. Thus, in the transmit mode, RF (radio frequency) energy from a feed network is phase shifted (by direct or time-delay phase shifting) and radiated from the array of aperture elements, while in the receive mode, RF received through the aperture elements is phase shifted and RF-coupled to the feed network.

1. Frequency Scan With Phase-Shift Stabilization

The phased frequency steering technique of the invention uses phase shift elements to stabilize the scan angle of a frequency scanning antenna array. A linear phased frequency array is configured from modules that each include a phase shifter, and an associated phase-shift aperture element together with a selected number of time delay aperture elements.

The phase-shift elements operate to stabilize the frequency-selected scan angle during instantaneous frequency changes, such as during frequency agile operations and/or FM-chirp pulse compression. Phase-shift stabilization results primarily from phase slope alignment, as described in Section 2.1.

Given current phase shifter response-time limitations, the phase-shift stabilization setting achieves precise phase slope alignment at only one frequency (typically the center frequency) of the instantaneous bandwidth. Thus transmitting a wideband pulse results in phase slope misalignments (see Section 2.1) that raise sidelobe levels somewhat. This effect, however, is minimized because the received signal is normally integrated over the transmit pulse. For example, in the case of FM-chirp, conventional matched filter processing on receive performs such an integration.

As a result, the phased frequency steering technique of the invention permits an array configured for frequency scanning to achieve instantaneous bandwidth performance comparable to a phase steered array, but with about one-fifth the phase shifters or less. The distributed phase shift elements provide frequency-independent stabilization at the scan angle as instantaneous frequency changes during a wideband pulse.

For a given instantaneous bandwidth, the phased frequency steering technique provides a straightforward cost/performance trade-off between the number of phase shifters and the sidelobe levels.

2. Phased Frequency Steered Array. The phased frequency steering technique of the invention uses a linear array of phase-shift/time-delay modules, each including a phase shift element and a selected number of time-delay elements.

An exemplary phased frequency array configuration is illustrated in FIG. 1*a*. A phased frequency array 10 is configured to provide a linear array of forty equidistant radiating elements, twenty in each symmetrical half.

Each half includes a series of phase-shift/time-delay modules according to the invention, as well as one phase-shift module that does not include a time-delay element, located at the center of the array. As shown in the enlarged view in FIG. 1*b*, each phase-shift/time-delay module includes a phase-shifter PS RF-coupled to (a) a phase-shift aperture element PSE, and (b) at least one time-delay aperture element TDE, through a respective time-delay feed TDF.

Referring to the left half of the phased frequency array 10, phase-shift module 21 is located at the center feed point. Extending outward, the array includes two two-element phase-shift/time-delay modules 22, two three-element phase-shift/time-delay modules 23, a single four-element phase-shift/time-delay module 24, and at the outer edge of the array, a single five-element phase-shift/time-delay module 25.

The phased frequency array 10 is RF-coupled to a TX/RX feed network 30 that injects RF energy into the array for the transmit mode, and extracts RF energy from the array in the receive mode. This RF feed operation is conventional, and is illustrated by a magic tee 31 configured to couple RF energy to and from the array 10. In the transmit mode, transmit-RF from a transmit amplifier 34 is RF-coupled through a circulator 32 to the array 10. In the receive mode, the magic tee 31 couples the frequency-difference component of the receive-RF through the circulator to a low-noise amplifier 36, and the frequency-sum component of the receive-RF through the circulator to a low-noise amplifier 38.

Each phase-shift/time delay module, and each phase-shift module, includes a phase shifter that is selectively set to introduce a specific phase-shift $\phi$. A desired scan angle in the plane of the array is achieved by appropriately selecting the scan frequency. The individual phase shifts $\phi$ for each module in the array are cooperatively selected in conjunction with the scan frequency to produce a continuous phase slope at the selected scan angle (see Section 2.1). Thus, in the transmit mode, the RF signal at a specific frequency from the TX/RX feed network 30 is fed to each of the phase-shift/time-delay and phase-shift modules in the linear array. From the left, the five-element phase-shift/time-delay module 25 introduces a selected phase-shift $\phi_0$, and the phase-shifted RF is (a) radiated through a phase-shift aperture element, and (b) sequentially coupled to each time-delay aperture element through its associated time delay feed, introducing corresponding selected time-delay phase-shifts. Similarly, the single four-element phase-shift/time-delay module 24 introduces a phase shift $\phi_1$ (and associated time-delay phase-shifts), the two three-element modules 23 introduce respective phase shifts $\phi_2$ and $\phi_3$ (and associated time-delay phase-shifts), and the two two-element modules 22 introduce respective phase shifts $\phi_4$ and $\phi_5$ (and associated time-delay phase-shifts). Finally, the phase-shift module 21 introduces a phase shift $\phi_6$.

The operation of the right half of the linear array of phase-shift/time-delay and phase-shift modules is identical. The seven modules introduce respective phase-shifts $\phi_7$–$\phi_{13}$, and associated time-delay phase-shifts.

The approach to selecting specific phase shifts $\phi_0$–$\phi_{13}$, and the associated time-delay phase-shifts, for the respective phase-shift/time-delay and phase-shift modules is described in Section 3.

Selecting the phase-shift/time-delay and phase-shift modules for a specific phased frequency antenna array according to the invention is a matter of design choice, given specifications for the frequencies of operation, total bandwidth (the frequency agile band), instantaneous bandwidth, and sidelobe levels. The phased frequency antenna configuration shown in FIG. 1A is exemplary only, and is not meant to indicate an actual system configuration. Rather, the exemplary array illustrates two significant aspects of configuring an array according to the phased frequency steering technique of the invention: (a) using phase-shift/time-delay modules with a selected number of time-delay elements, and using phase-shift modules, to achieve a selected phase-shifter distribution; and (b) increasing the ratio of time-delay elements to phase shift elements toward the edge of the antenna aperture (i.e., increasing phase shifter "thinning") in accordance with conventional antenna pattern weighting considerations.

2.1. Phase Slope Alignment. The phased frequency steered antenna of the invention uses conventional frequency scanning, with the selectively distributed phase shifters being used to stabilize the scan angle as instantaneous frequency changes over the transmit pulse bandwidth, such as for frequency agile operations and/or FM-chirp pulse compression.

Specifically, for a given scan frequency, the phase shifters are cooperatively set to align the phase slopes for the time delay phase-shifts in successive phase-shift-/time-delay modules. Each phase shifter introduces a respective phase-shift offset to produce a continuous phase slope across the phased frequency antenna array, i.e., from module to module.

The phase slope alignment technique is illustrated in FIG. 1*c*, taken in conjunction with the phased frequency array 10 in FIG. 1*a*. In the transmit mode, to achieve a scan angle $\theta$ (ignoring at this point instantaneous frequency changes), the TX/RX feed network 30 feeds RF at the appropriate scan frequency to the phased frequency array 10. That is, for that scan frequency, the phased frequency antenna radiates a waveform with a phase front 50 at an angle $\theta$ with respect to the linear antenna array.

With reference to the three-element phase-shift/time-delay module in FIG. 1*b*, the time-delay aperture elements TDE introduce time delay phase-shifts such that the desired phase slope $\theta$ is generated for that module. That is, for the three-element module shown, each time-delay feed TDF introduces a corresponding phase-shift (i.e. time delay) such that the phase front across the module is at the desired scan angle $\theta$. The phase front associated with each phase-shift/time-delay module is designated as a phase front segment.

With reference to FIG. 1*c*, the phase front 50 radiated by the phased frequency antenna 10 is formed by a sequence of phase front segments $S_1$–$S_{13}$, each associated with a corresponding phase-shift/time-delay or phase-shift module. Thus, from the left, the five-element module 25 radiates a phase front segment $S_0$, the adjacent four-element module radiates a phase front segment $S_1$, the adjacent three-element module 23 radiates a phase front segment $S_3$, and so on, with the five-element module 25 on the far right of the antenna array radiating a phase front segment $S_{13}$.

For each phase-shift/time-delay or phase-shift module, the associated phase shifter introduces a phase shift $\phi$ cooperatively selected in conjunction with the scan frequency to align the phase slopes of phase front segments, creating a continuous phase slope across phase front 50. That is, a continuous phase front is generated when the phase front segments S for each phase-shift-/time-delay and phase-shift module are aligned by the respective phase shifts $\phi_0$–$\phi_{13}$.

Thus, the phase shifters can be viewed as introducing a phase-shift offset for each phase front segment of an associated module. At a given scan frequency, each phase slope offset aligns the corresponding phase front segment radiated by phase-shift/time-delay or phase-shift module to produce a phase front 50 with a continuous phase slope. Because these phase-shift offsets $\phi_0$–$\phi_{13}$ are fixed for a given scan frequency, and are independent of instantaneous frequency changes, they serve to stabilize the scan angle over the instantaneous bandwidth (see Section 1).

For conventional broadband operation, at each scan angle the phased frequency antenna transmits a wide-band pulse (such as for FM chirp) causing instantaneous frequency changes. While the phase-shift offsets $\phi_0$–$\phi_{13}$ provided by the individual phase shifters remains constant, the phase slope of the phase front segment associated with a particular phase-shift/time-delay module does not. Rather, the time-delay phase-shifts associated with each segment change with frequency, changing the phase slope for the module.

Thus, a continuous alignment of the phase front segments to the desired phase front 50 can only be obtained at the particular scan frequency (i.e., the frequency to which the phase shifters are set). For example, for FM-chirp pulse compression, the scan frequency for a given scan angle is typically located at about the center frequency for the chirp-pulse bandwidth. Thus, for a given scan angle, the transmit frequency provided by the TX/RX feed network 30 is modulated from the chirp frequency at the low end of the instantaneous bandwidth, through the scan frequency, to the chirp frequency at the high end of the instantaneous bandwidth. As indicated, the phase-shift offsets $\phi_0$–$\phi_{13}$ are selected to align the phase front segments to the phase front only at the scan frequency.

At instantaneous frequencies removed from the scan frequency, the phase slope of the phase front segment associated with each phase-shift/time-delay module will be correspondingly different from the desired continuous slope of the phase front for the antenna array. As a result, for frequencies off the scan frequency, sidelobe level will come up to reflect the misalignment of phase front segments with respect to the desired phase front. This effect on sidelobe level is reduced by integrating the return signal, as described in Section 1.

For a given instantaneous bandwidth, the effect of instantaneous frequency changes on sidelobe level is dependent upon the substitution ratio for the phase-shift elements (i.e. the number of frequency-shift-independent phase shift elements that are introduced in place of frequency-dependent time delay elements). Again, selecting the appropriate phase-shifter distribution (both number and location in the array) to achieve a desired sidelobe level performance for a specified instantaneous bandwidth is a design choice involving a straightforward cost/performance tradeoff (see Section 2.2).

Cooperatively selecting the phase-shift offsets $\phi_0$–$\phi_{13}$ for each scan frequency to produce phase front segments aligned for the selected scan angle is accomplished using conventional beam steering analysis. Likewise, controlling the phase shifters to produce the desired sequence of phase-shift offsets $\phi_0$–$\phi_{13}$ for a given scan frequency is accomplished conventionally. Typically, the phase shifter for each phase-shift/time-delay and phase-shift module in the phased frequency array is set to a selected phase-shift offset during the dead-time between radar pulses.

In that regard, this approach to adjusting the phase-shift offsets $\phi_0$–$\phi_{13}$ for the phase-shift/time-delay modules such that the phase slopes of the phase front segments are aligned to the desired phase front only at the center (scan frequency) of the instantaneous bandwidth is a result of component response-time limitations rather than any inherent limitation in the phased frequency steering technique. That is, it is impractical with current technology to continuously adjust phase shifter setting throughout the instantaneous bandwidth—to accommodate a typical 50 microsecond scan time, the phase shifters would be required to respond in nanoseconds. At least for the transmit mode, should component technology improve to allow phase shifter adjustments on the order of nanoseconds, the phase-shift offsets $\phi_0$–$\phi_{13}$ for the individual phase shifters could be altered to reflect changes in instantaneous frequency, maintaining continuous phase slope alignment with the desired phase front.

2.2 Array Configuration. The phased frequency antenna array of the invention is configured to provide conventional frequency steering, with phase-shift stabilization using the phase shifters of the phase-shift/time-delay and phase-shift modules. For specified total and instantaneous bandwidths, the phased frequency steered antenna is configured in accordance with a cost/performance tradeoff between the number of phase shifters in an array and the associated sidelobe level performance over the instantaneous bandwidth.

In configuring an array for a particular phase-shift-/time-delay aperture element ratio, conventional weighting analysis is used to determine an optimum configuration (i.e. an optimum sequence of phase-shift and time-delay elements). A weighted distribution of phase-shift elements is illustrated by the exemplary phased frequency array 10 shown in FIG. 1*a* (which, again, is configured for the purpose of illustration only).

In accordance with conventional weighting analysis, antenna performance in the center of the array is more critical than at the edges of the array. This is illustrated in the exemplary configuration of the phased frequency array 10 by the concentration of phase shifters in the center of the antenna aperture, with the phase shifter "thinning" increasing toward the edges of the array. Thus, referring to the symmetrical left half of the array 10, the center-most radiating element is provided by a phase-shift module 21 that does not include any time-delay elements. Adjacent to the phase-shift module are two two-element phase-shift/time-delay modules 22, each with a single time-delay element. The phase-shifter ratio is gradually decreased, using two three-element modules, a four-element module and finally, on the left end of the array, a five-element phase-shift/time-delay module 25 that includes four time-delay elements for a single phase-shift element.

The detailed configuration of the phased frequency steered antenna array, and in particular, antenna aperture dimensions and aperture-element spacing, is determined conventionally. The appropriate spacing between phase-shift and the time-delay elements is determined by the operational frequency requirements and scan limits. The total size of the array, i.e. total number of phase-shift and time-delay elements independent of phase shifter distribution depends upon real beam resolution and the desired power aperture product. The overall aperture configuration parameters will typically be selected independent of the configuration of the individual phase-shift/time-delay modules. That is, the phased frequency steering technique of the invention has generalized application to antenna structures independently configured for a selected array-size and operational frequency range.

Selecting the type of phase-shift and time-delay elements is a design choice. The phased frequency technique of the invention is adaptable to either passive or active or passive/active arrays. That is, the individual phase-shifters can be either passive (such as a wound ferrite cores) or active (such as TX/RX MMIC solid state modules). For the time-delay elements, an exemplary conventional serpentine waveguide feed is described in Section 4, although other approaches (such as solid state time-delay) can be used.

Selecting an aperture element configuration is a design choice. An exemplary conventional waveguide aperture using directional couplers is described in Section 4.

3. Two-Dimensional Array. A phased frequency steered antenna according to the invention can be configured for two-dimensional scanning by stacking a selected number of linear phased frequency arrays, such as the exemplary array 10 in FIG. 1*a*. Scanning in the stack dimension is accomplished by phase steering, and thus does not involve the instantaneous bandwidth and sidelobe level considerations that affect frequency scanning in the plane of the linear arrays.

Figure 2:
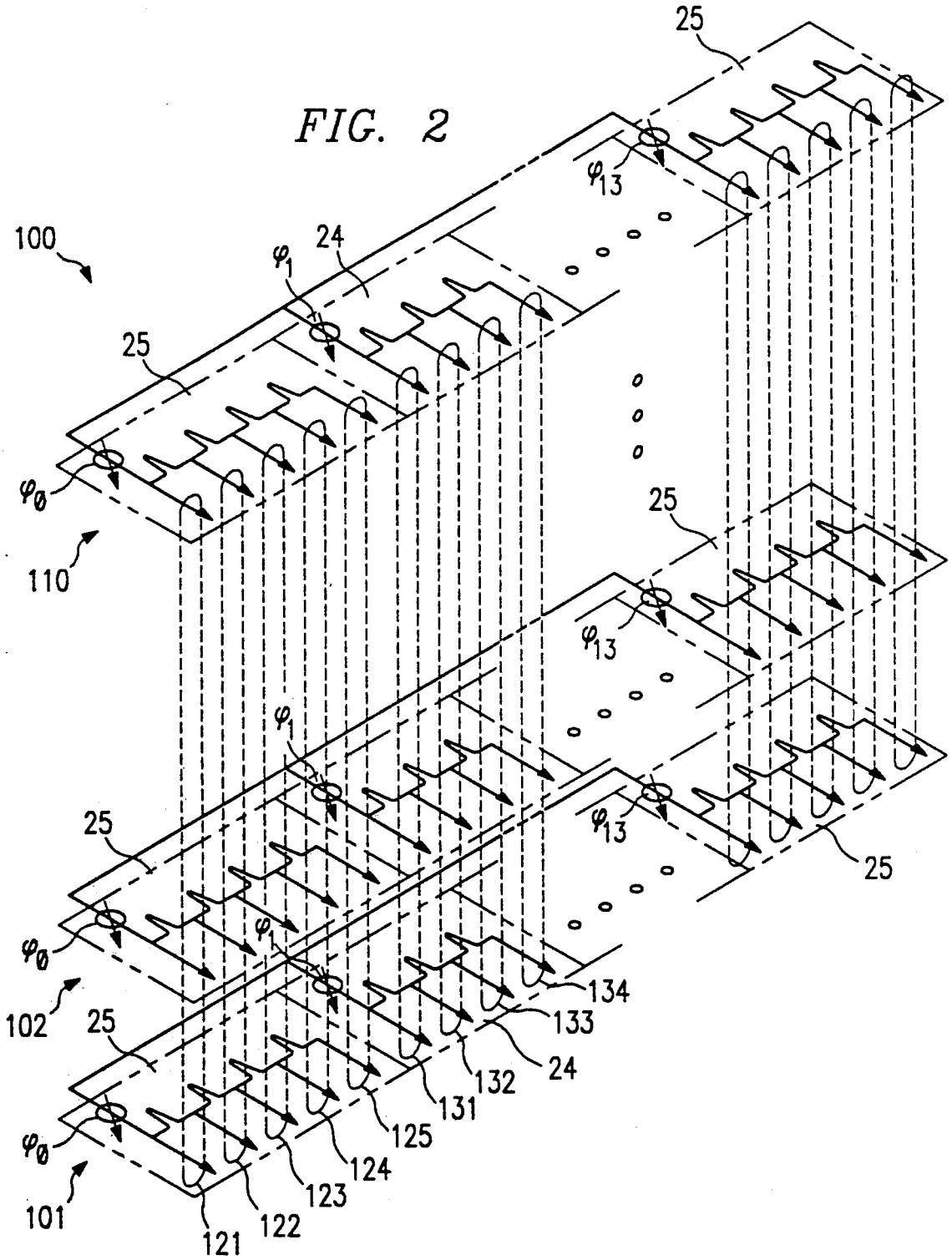
FIG. 2 illustrates an exemplary two-dimensional phased frequency antenna configuration formed by a stack of phased frequency linear arrays.

A 10×20 two-dimensional array is illustrated in FIG. 2. A two-dimensional array 100 is formed by a stack of identically configured linear phased frequency arrays in the exemplary configuration shown in FIG. 1*a*. Thus, the two-dimensional array 100 includes a stack of ten linear arrays 101–110. Designating the plane of the linear array as horizontal (azimuth) and the stack plane as vertical (elevation), the two-dimensional array 100 is formed by an array of forty vertical columns of radiating elements (either phase shift or time delay).

For example, at the left end of the array, a stack of five-element phase-shift/time-delay modules includes a column of phase-shift elements 121, and adjacent columns of time-delay elements 122–125, each fed by a respective phase shifter. An adjacent stack of four-element phase-shift/time-delay modules includes a column of phase shifters 131, and adjacent columns of time-delay elements 132–134.

For the exemplary configuration shown in FIG. 1*a*, each linear array 101–111 includes thirteen phase-shift elements, each providing an associated phase shift $\phi_0$–$\phi_{13}$. These phase shifters feed corresponding phase-shift aperture elements, and a total of twenty-seven respective time-delay aperture elements. Thus, the two dimensional array 100 includes forty columns of aperture elements, including 13 columns of phase-shift elements distributed horizontally in accordance with the phase-shift/time-delay element distribution in the linear arrays 101–110.

The two-dimensional phased frequency steered array 100 accomplishes an elevation scan using conventional phase steering. That is, azimuth (horizontal) scan angle is determined as described in Section 2.1 by cooperatively selecting both frequency and the phase-shift offsets $\phi_0$–$\phi_{13}$ for each phase-shift element in a linear (horizontal) array, yielding a corresponding phase difference between successive phase-shift offsets (i.e. between the settings of adjacent phase shifters). At that scan angle, an elevation (vertical) scan is accomplished by appropriately selecting the set of phase-shift offsets $\phi_0$–$\phi_{13}$ for each linear array, maintaining the phase differences within each set that are associated with the selected scan angle.

Thus, phase steering accomplishes a vertical scan by appropriately selecting the set of phase-shift offsets $\phi_0$–$\phi_{13}$ for each of the linear arrays 101–110 relative to the other sets of phase-shift offsets $\phi_0$–$\phi_{13}$ to achieve a desired elevation scan angle, while maintaining the phase-shift differences for each set of phase-shift offsets corresponding to the desired azimuth scan angle. During an elevation scan, each time-delay element in a column changes in phase (but not frequency) in accordance with phase-shift changes for the associated phase shift element.

Because the vertical elevation scan is accomplished by phase steering, rather than frequency steering, instantaneous frequency changes do not affect angular accuracy of the elevation scan or sidelobe levels. Thus, instantaneous bandwidth and sidelobe levels for the elevation scan are not affected by the cost/performance tradeoff that establishes the relative distribution of phase-shift/time-delay elements in each linear array 101–110.

Accordingly, selecting a configuration for a two-dimensional phased frequency steered antenna array focuses on the design choices associated with configuring a linear array of phase-shift/time-delay and phase-shift modules to achieve the desired instantaneous bandwidth and sidelobe level performance for scanning in the plane of the linear array. Extending that phased frequency linear array to two dimensions is a matter of vertically stacking a selected number of linear arrays to achieve a desired elevation beamwidth and two-dimensional power aperture product.

Figure 3:
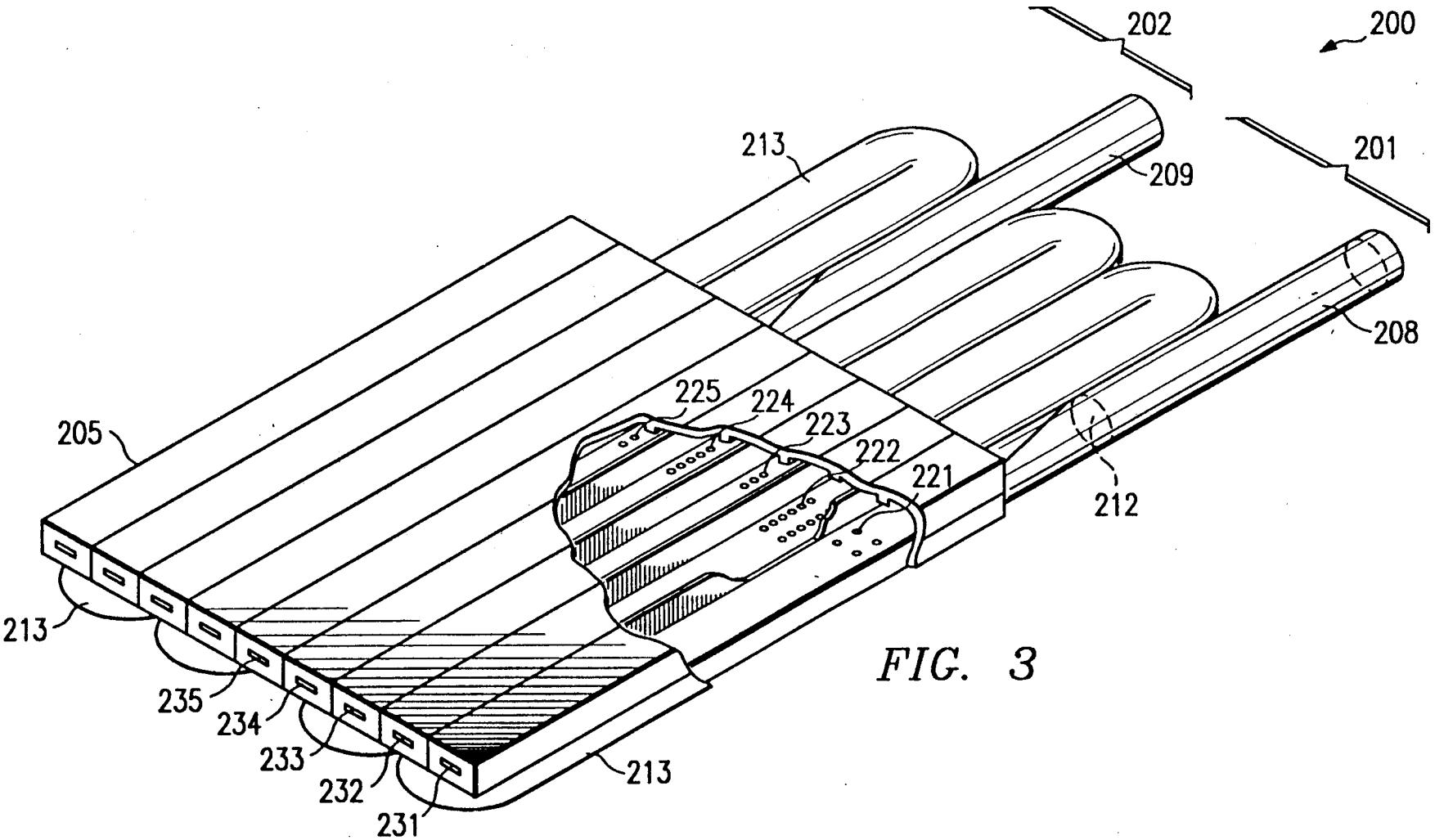
FIG. 3 is an exemplary microwave waveguide configuration of a portion of a phased frequency array.

4. Exemplary Microwave Module. The phased frequency steering technique of the invention is generally applicable to the configuration of antenna arrays using a variety of antenna aperture structures, TX/RX feed networks and phase shift and time delay elements. An exemplary microwave module implementation is shown in FIG. 3.

A Section 200 of a phased frequency array includes two microwave phase-shift/time-delay modules 201 and 202. These modules are coupled to antenna aperture waveguides 205 providing a series of equally spaced slotted antenna radiation apertures. The microwave modules are coupled to a TX/RX RF feed network (now shown) through feed channels 208 and 209.

In the microwave module 201, RF energy is coupled through a phase shifter, represented by a module 212, that introduces a selected amount of phase shift. For the transmit mode, RF energy fed through the phase shifter 212 is introduced into a serpentine feed waveguide network 213 that RF-couples the phase-shifted RF energy into the associated antenna aperture waveguides 205 with a selected time delay attributable to transmitting through the serpentine feed, producing associated time-delay phase-shifts.

Thus, phase-shifted RF is immediately coupled through a directional coupler 221 into a phase-shift aperture waveguide 231. After a selected time delay, correspondingly phase-shifted RF is coupled through a directional coupler 222 into a first time delay aperture waveguide 232. Similarly, after appropriate time delays (and corresponding phase shifts), phase-shifted RF is coupled through directional couplers 223–225 into respective time delay aperture waveguides 233–235.

The exemplary microwave module is conventional in design. The phase-shift component may be either passive or active (such as a TX/RX MMIC module). The serpentine feed waveguide is configured to provide the desired amount of time-delay phase-shift for each of the time-delay elements. The directional couplers are configured to couple a selected amount of RF energy into respective aperture waveguides.

5. Conclusion. The phased frequency steering technique of the invention uses frequency steering for broadband applications, such as FM chirp, by providing phase-shift stabilization for the scan angle. The number of phase-shift elements required for stabilization is significantly fewer than for a sparsely sampling (thinned) phase steered array providing comparable sidelobe level performance over a given instantaneous bandwidth. The relative immunity to angular scan errors caused by changes in instantaneous frequency is significantly improved over a frequency steered array without phase-shift stabilization. Thus, for a given instantaneous bandwidth, a straightforward cost/performance tradeoff can be made between the number of phase shifters and the sidelobe level.

The phased frequency steering technique uses phase-shift/time-delay modules that include a phase shifter, an associated phase-shift aperture element and one or more time delay aperture elements. In addition, phase-shift modules without time delay elements may be used in portions of the array to accommodate a desired weighting function. These modules are configured in a linear array to achieve a desired distribution of phase-shift elements with respect to time-delay elements—in general, for a given instantaneous bandwidth, decreasing the number of phase-shift elements increases sidelobe levels (although sidelobe level performance is significantly improved over that available from a correspondingly depopulated phase steered array). For a given scan frequency, the phase shifters are set to provide corresponding phase-shift offsets that align the phase slopes for the time-delay phase-shifts across the linear array, producing a continuous phase front at the desired scan angle. A two-dimensional array is obtained by stacking a selected number of linear phased frequency arrays.

Although the present invention has been described with respect to an exemplary embodiment, various changes and modifications may be suggested to one skilled in the art, and it is intended that the present invention encompass such changes and modifications as fall within the scope of the independent claims.

What is claimed is:

1. A phased frequency steered antenna array for transmitting or receiving RF signals, comprising:

multiple phase-shift/time-delay modules, each including a phase-shift component RF-coupled to associated phase-shift and time-delay aperture elements;

each phase shift component introducing a respective selected phase shift to an RF signal that is input to such component;

each phase shift component being RF-coupled to a phase-shift aperture element; and each phase shift component being RF-coupled to at least one time-delay aperture element for introducing a selected time-delay phase shift to an RF signal input to such element;

such that the array includes a selected distribution of phase-shift and time-delay aperture elements.

2. The phased frequency steered array of claim 1, further comprising:

at least one phase-shift module that includes a phase shift component RF-coupled to an associated phase-shift aperture element;

said phase-shift component introducing a selected phase shift to an RF signal input to such component.

3. The phased frequency steered array of claim 1, wherein the RF signals are characterized by an instantaneous bandwidth, and wherein the distribution of said phase-shift and time-delay elements is selected to achieve a desired sidelobe level performance.

4. The phased frequency steered array of claim 3, wherein the antenna pattern is amplitude weighted, and wherein the distribution of said phase-shift and time-delay elements takes into account such amplitude weighting.

5. The phased frequency steered array of claim 1, wherein said multiple phase-shift/time-delay modules are configured in at least one linear array with a selected linear distribution of phase-shift and time-delay aperture elements.

6. The phased frequency steered array of claim 5, wherein the respective phase shifts introduced by said multiple phase-shift components are cooperatively selected to receive RF signals arriving from a predetermined scan direction in the plane of said linear array.

7. The phased frequency steered array of claim 5, wherein the respective phase shifts introduced by said multiple phase-shift components are cooperatively selected to transmit and RF signal at a predetermined scan direction in the plane of said linear array.

8. The phased frequency steered array of claim 5, wherein said multiple phase-shift/time-delay modules are configured in a two-dimensional array formed by multiple stacked linear arrays of phase-shift/time-delay modules.

9. The phased frequency steered array of claim 8, wherein said two-dimensional array is frequency steered in the plane of said linear arrays and phase steered in the stack dimension.

10. The phased frequency steered array of claim 1, wherein the RF signals are characterized by an instantaneous bandwidth, and wherein the respective phase shifts introduced by said phase-shift components are cooperatively selected with respect to the frequencies of the RF signals to provide corresponding phase shift offsets for said phase-shift/time-delay modules to align the respective phase front segments for said modules, at least at a predetermined alignment frequency in the instantaneous bandwidth.

11. The phased frequency steered array of claim 10, wherein said alignment frequency is about the center frequency of the instantaneous bandwidth.

12. The phased frequency steered array of claim 1, wherein said phase-shift components are passive.

13. The phased frequency steered array of claim 1, wherein said phase-shift components are MMIC active modules.

14. The phased frequency steered array of claim 1, wherein said time-delay elements are passive.

15. The phased frequency array of claim 1, wherein the RF signals are characterized by an instantaneous bandwidth, further comprising the step of aligning the phase front segments of each phase-shift and associated time-delay element, at least at a predetermined alignment frequency, by cooperatively selecting the respective phase shifts of said phase-shift elements with respect to the frequencies of the RF signals to provide respective phase-shift offsets.

16. The phased frequency array of claim 10, wherein said alignment frequency is about the center frequency of the instantaneous bandwidth.

17. A phased frequency steering method for an antenna array that transmits or receives RF signals, comprising:

configuring an array with a selected distribution of multiple phase-shift aperture elements and multiple time-delay aperture elements, each phase-shift element being RF coupled to at least one time-delay element;

for each phase-shift aperture element, introducing a selected phase shift to an RF signal input to said element;

for each time-delay aperture element, introducing a time-delay phase-shift to an RF signal input to said element;

selectively steering the antenna array by selecting the respective phase shifts introduced by said phase-shift elements in relation to the frequency of the RF signals input to those elements.

18. The phased frequency steering method of claim 17, wherein the RF signals are characterized by an instantaneous bandwidth, and wherein the distribution of said phase-shift and time-delay elements is selected to achieve a desired sidelobe level performance.

19. The phased frequency steering method of claim 18, wherein the antenna pattern is amplitude weighted, and wherein said distribution of phase-shift and time-delay elements takes into account such amplitude weighting.

20. The phased frequency steering method of claim 17, further comprising the step:

including in the array at least one phase-shift aperture element that introduces a selected phase shift to an RF signal input to said element, and is not RF-coupled to a time-delay aperture element.

21. The phased frequency steering method of claim 17, wherein the step of configuring comprises configuring the selected distribution of said phase-shift and time-delay aperture elements into a linear array.

22. The phased frequency steering method of claim 21, wherein the step of selectively steering the array comprises the step of selectively steering the array to receive RF signals arriving from a predetermined scan direction in the plane of said linear array by cooperatively selecting respective phase shifts introduced by said multiple phase-shift elements with respect to the frequency of the RF signals input to those elements.

23. The phased frequency steering method of claim 21, wherein the step of selectively steering the array comprises the step of selectively steering the array to transmit an RF signal at a predetermined scan direction in the plane of said linear array by cooperatively selecting respective phase shifts introduced by said multiple phase-shift elements with respect to the frequency of the RF signals input to those elements.

24. The phased frequency steering method of claim 21, wherein the step of configuring further comprises stacking multiple linear arrays of phase-shift and time-delay elements, to form a two-dimensional array.

25. The phased frequency steering method of claim 24, wherein the step of steering comprises the steps of:

frequency steering said two-dimensional array in the plane of said linear arrays; and phase steering said two-dimensional linear array in the stack dimension.

* * * * *